US010472022B1

(12) United States Patent
Pollen

(10) Patent No.: US 10,472,022 B1
(45) Date of Patent: Nov. 12, 2019

(54) RELEASABLE BIMINI TOP

(71) Applicant: Randall Paul Pollen, Milford, IN (US)

(72) Inventor: Randall Paul Pollen, Milford, IN (US)

( * ) Notice: Subject to any disclaimer, the term of this patent is extended or adjusted under 35 U.S.C. 154(b) by 0 days.

(21) Appl. No.: 16/162,447

(22) Filed: Oct. 17, 2018

(51) Int. Cl.

| | |
|---|---|
| ***B63B 17/02*** | (2006.01) |
| ***B63B 17/00*** | (2006.01) |
| ***E04H 15/48*** | (2006.01) |
| ***E04H 15/06*** | (2006.01) |

(52) U.S. Cl.
CPC ..... *B63B 17/02* (2013.01); *B63B 17/00* (2013.01); *E04H 15/06* (2013.01); *E04H 15/48* (2013.01)

(58) Field of Classification Search
CPC ..... B63B 17/00; B63B 17/02; B63B 17/04; B63B 19/00
USPC ..... 114/361, 364
See application file for complete search history.

(56) References Cited

U.S. PATENT DOCUMENTS

| | | | | |
|---|---|---|---|---|
| 4,404,714 | A * | 9/1983 | Duran | F16B 21/165 403/322.2 |
| 5,367,977 | A | 11/1994 | Ellis et al. | |
| 6,379,072 | B1 * | 4/2002 | Brown | F16B 21/165 403/322.2 |
| 6,672,241 | B2 | 1/2004 | Warfel | |
| 6,820,569 | B2 | 11/2004 | Warfel | |
| 6,907,642 | B1 | 6/2005 | Czipri | |
| 7,051,669 | B2 | 5/2006 | Warfel et al. | |
| 7,107,926 | B2 | 9/2006 | Fishburn | |
| 7,162,968 | B2 | 1/2007 | Alexander et al. | |
| 7,430,980 | B2 * | 10/2008 | Fishburn | B63B 17/02 114/361 |
| 9,783,267 | B1 | 10/2017 | Alexander et al. | |
| 9,815,525 | B2 | 11/2017 | Hough | |

* cited by examiner

*Primary Examiner* — Lars A Olson
(74) *Attorney, Agent, or Firm* — Botkin & Hall, LLP

(57) ABSTRACT

A Bimini top attaching system has a mounting bracket that is affixed to a watercraft and a latch affixed to a frame tube. The latch has a main body with a tube portion that is located inside the tube and a hook portion that is exposed. The latch includes a movable catch that slides inside a catch trough between a locked and unlocked position, with a spring biasing the catch towards the locked position. In the locked position, a chisel point on the catch interrupts a transverse notch in the hook portion. Moving the catch to the unlocked position allows a pin on the mounting bracket to pass in and out of the transverse notch. The catch is restrained in the catch trough when the tube portion is located inside the tube.

19 Claims, 8 Drawing Sheets

36
46
116

47
68
96
80
150
94
112
82
140
142
36
120
20
48
126
110
100
124
46
114
68
96
80
92
24
86
58

50
130
34
150
19
19
18

98
94
96
80
20
87
84
92
100
85
88
24
120
126
110
82
90
72
71
70
68
62
60
64
75
56
112
122
124
48
42
52
50
40
54
44
74

RELEASABLE BIMINI TOP

BACKGROUND OF THE INVENTION

This present disclosure relates to Bimini tops and mechanisms that hold the fabric. The frames that hold the fabric typically are made from hollow tubing, either square or round. Different parts of the frame are coupled together with brackets, joints, pins, or bolts. The Bimini top is movable between a folded and stored position to an unfolded and use position. The movement between the stored and use position frequently requires parts of the frame to be attached and detached from the boat, while other parts act as hinges and pivots. Many attempts to simplify the steps to move the top between the use and stored position have been made, with each having drawbacks. These drawbacks include having to deal with extra parts that get lost, components that are difficult to align, and searching for tools. Other tops have flimsy, complicated, or brittle parts that break or disconnect, causing inconvenience or danger to the user. Further, the existing devices for Bimini top frames typically do not allow easy removal of the entire frame from the boat. Bimini tops frequently require hinge points, which are not provided in many mounting hardware options. An improved Bimini top frame connection system is needed.

SUMMARY OF THE INVENTION

The present disclosure describes a Bimini top having a quick release system that allows the entire top to be removed and installed by releasing a latch that also serves as a hinge when connected to a mounting bracket. The top has quick releases with mounting brackets that affix to the watercraft. The mounting bracket is affixed to the watercraft and has upstanding walls and a pin that is affixed between them. The latch is affixed at a terminal end of a hollow tube which makes up the Bimini frame. The latch includes a transverse notch that receives the pin that extends between the upstanding walls of the mounting bracket. The latch includes a movable catch that slides between a locked position and an unlocked position. In the locked position, a chisel portion obstructs the transverse notch to capture the pin between the chisel portion and the transverse notch. In the unlocked position, the chisel portion is clear of the transverse notch to allow the pin to be inserted in or removed from the transverse notch. The catch is constrained between the tube and the latch and is biased towards the locked position. Connecting the latch to the mounting bracket requires only aligning the pin with the transverse notch and applying pressure to overcome the biasing force of the catch. To disconnect the latch from the mounting bracket, the user moves the catch with a grip surface towards the unlocked position to remove the pin from the transverse notch.

DESCRIPTION OF THE PREFERRED EMBODIMENT

Figure 1A:
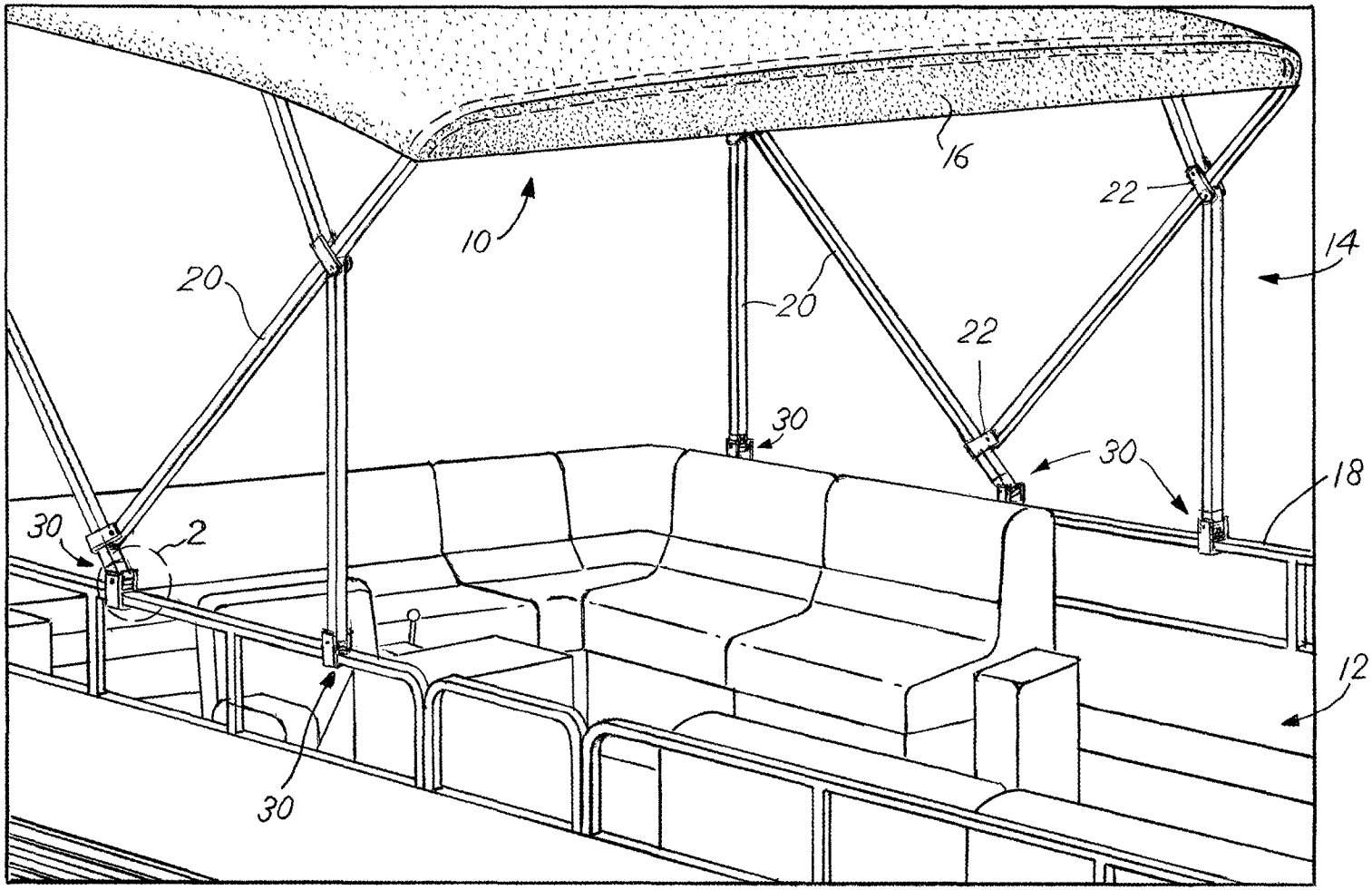
FIG. 1A is a front perspective view of a Bimini top and frame in the unfolded and use position on a watercraft.
Figure 1B:
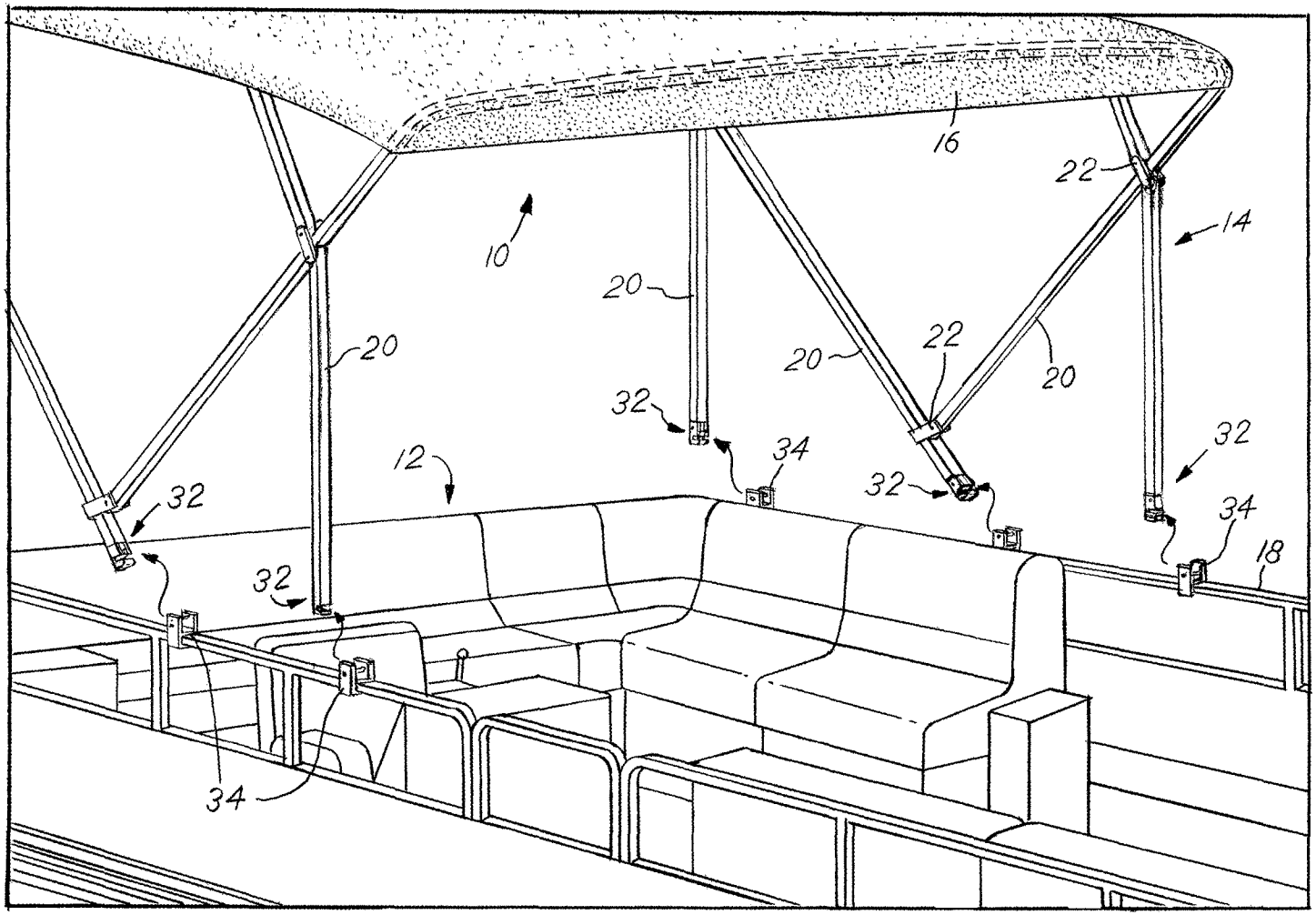
FIG. 1B is a front perspective view of the Bimini top and frame in FIG. 1A separated from the watercraft.
Figure 1C:
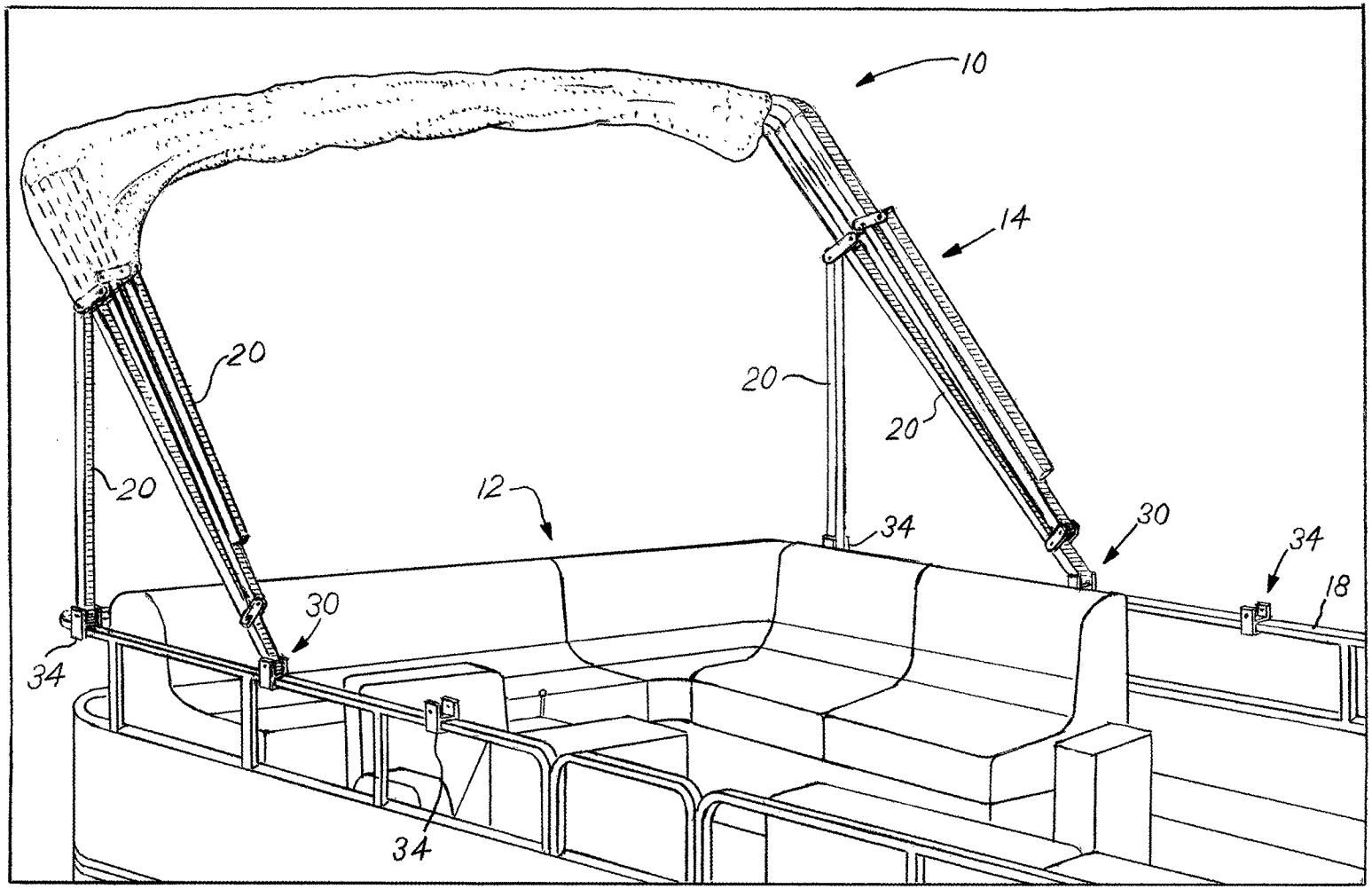
FIG. 1C is a front perspective view of the Bimini top and frame in FIG. 1A in the folded and stored position.
Figure 2:
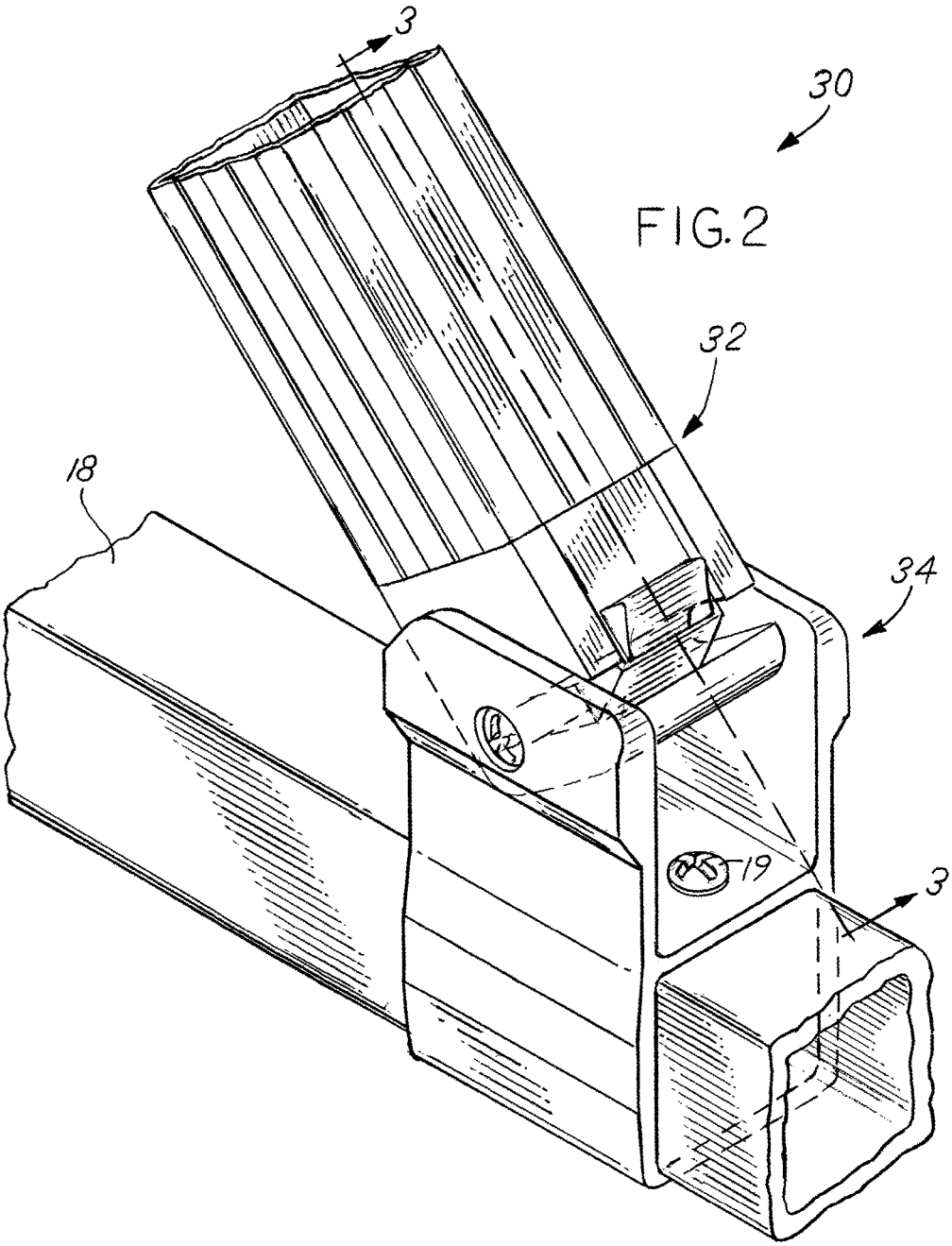
FIG. 2 is partial view 2 of the frame in FIG. 1A.

A Bimini top 10 is shown affixed to a watercraft 12 in FIGS. 1A and 1C. The Bimini top 10 has a frame 14 and top fabric 16. The top 10 can move between an unfolded and use position shown in FIG. 1A and a folded and stored position as shown in FIG. 1C. The top 10 is also removable, as shown in FIG. 1B. As shown, the top 10 is attached to railing 18 that is affixed to the watercraft 12, but other types of watercraft are contemplated, including but not limited to fiberglass hull watercraft or watercraft without railing. The frame 14 is commonly formed from hollow tubing 20 with portions of the frame 14 connected with pivoting joints 22. The pivoting joints 22 allow different portions of the frame 14 to fold for storage, as is shown in FIG. 1C.

The Bimini top 10 uses several releases 30, as shown in FIG. 1A. The components and more detail of the release system 30 are shown in FIGS. 2-8. The release system 30 uses a latch 32 that connects to a mounting bracket 34. The release system 30 also serves as a hinge when connected with the latch 32 also being referred to as a latching hinge. The latch 32 is affixed to the frame 14 and the mounting bracket 34 is affixed to the railing 18. The latch 32 has a main body 40 with a central axis 36 that has a tube portion 42 and a hook portion 44. The main body 40 is shown as formed from a single solid component that is machined, but it is contemplated that it is die cast, molded, or assembled from several components. The tube portion 42 resides inside the hollow tubing 20 and the hook portion 44 remains exposed. The latch 32 is retained in the tubing 20 with a bolt 46 that extends through the tubing 20 and a retention aperture 48 in the tube portion 42. The bolt 46 is secured with a locknut 47. It is contemplated that main body 40 is secured to the tube 20 through riveting, threaded fasteners, welding, or crimping. A shoulder surface 50 divides the main body into the tube portion 42 and the hook portion 44, and can abut a terminal edge 24 of the tube 20. The hook portion 44 includes a transverse notch 52 with a bottom surface 54. The transverse notch 52 has a close notch surface 56 and a far notch surface 58. As shown, the notch surfaces 56, 58 are parallel and face each other but it is contemplated that they are angled with respect to each other.

The main body 40 has a catch trough 60 with a bottom surface 62. The catch trough 60 extends from the tube portion 42 to the hook portion 44 and has sidewalls 64, 66 that extends between the notch 52 and terminates at a backstop surface 68. The bottom surface 62 extends from a spring support surface 72 to the close notch surface 56. The catch trough 60 has a narrow area 70 with side surfaces 71 to define the width. The narrow area terminates at the spring support surface 72.

Figures 3, 4:
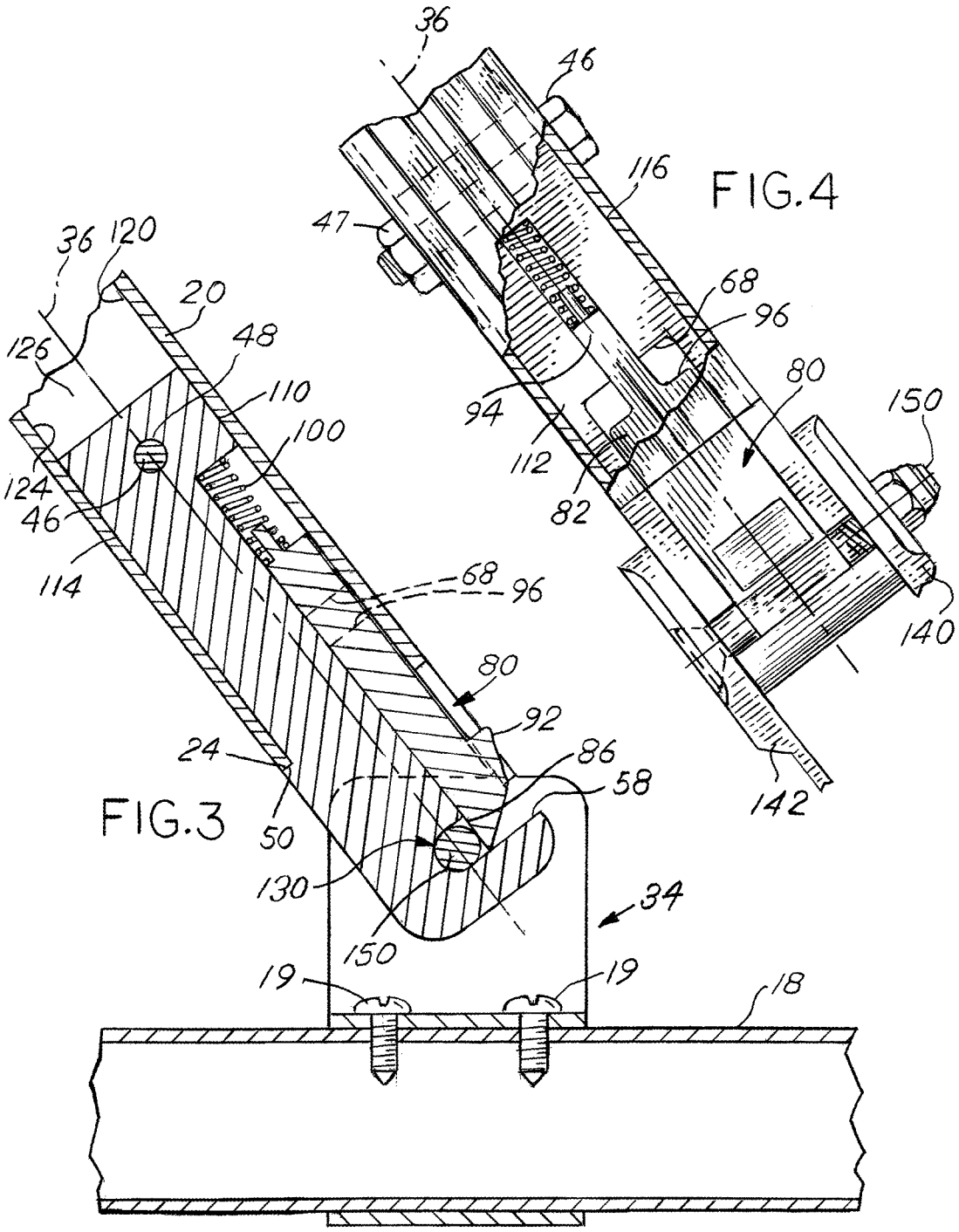
FIG. 3 is a side section view 3-3 of the frame in FIG. 2 with the frame latched to the mounting bracket.
FIG. 4 is a partial front view of the frame in FIG. 3 with the frame latched to the mounting bracket.
Figures 5, 6:
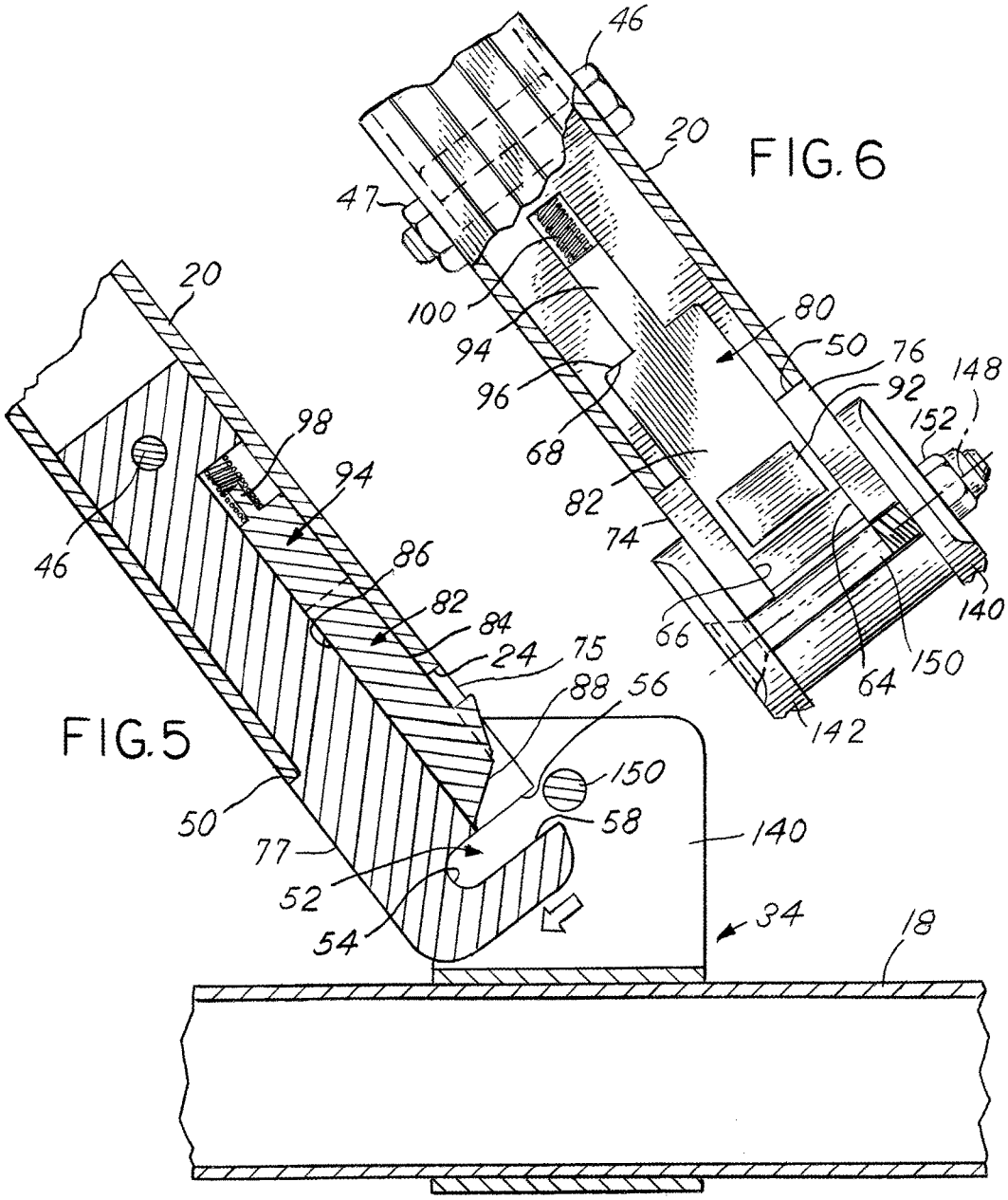
FIG. 5 is a side section view 3-3 of the frame with the frame being released from the mounting bracket.
FIG. 6 is a partial front view of the frame in FIG. 5 with the frame released from the mounting bracket.
Figure 7:
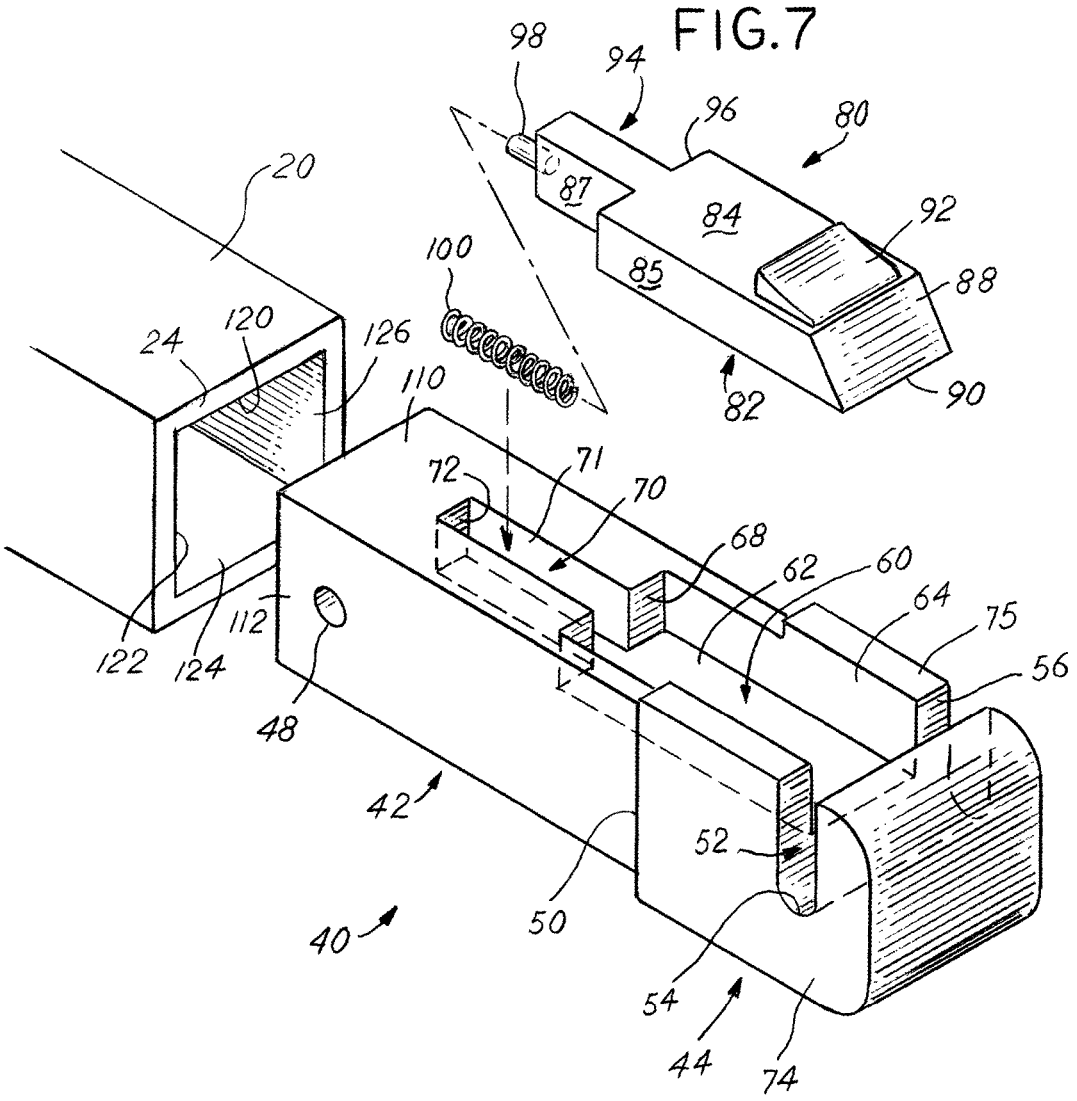
FIG. 7 is a front isometric exploded view of the frame end.
Figure 8:
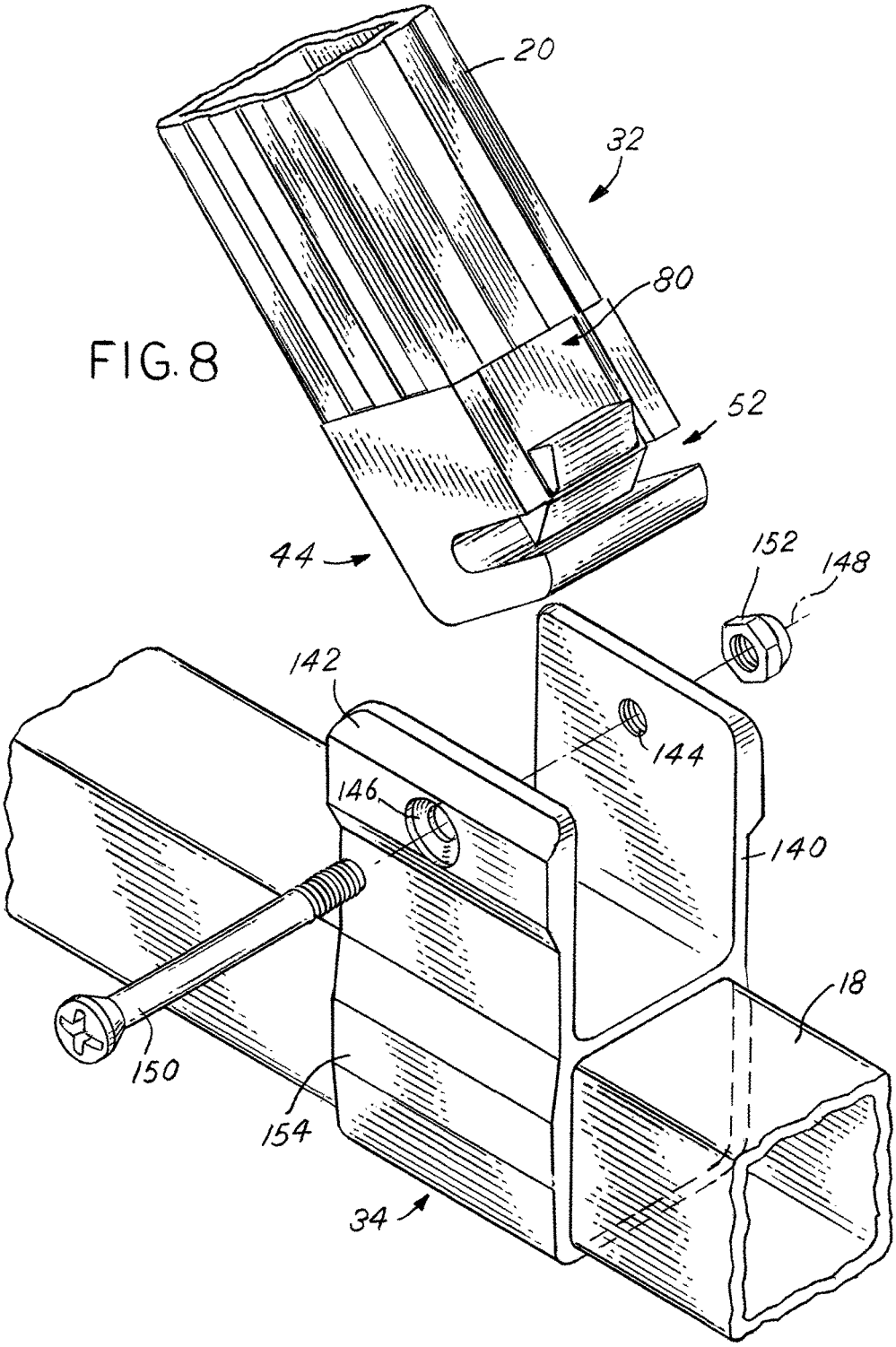
FIG. 8 is a front isometric view of the frame end before engagement with the mounting bracket.

A catch 80 resides in the catch trough 60 and slides between a locked and unlocked position. The locked position is shown in FIGS. 3 and 4, while the unlocked position is shown in FIGS. 5 and 6. The catch 80 has a chisel portion 82 with an outward facing surface 84 and an oppositely located inward facing surface 86. As shown, the surfaces 84, 86 are parallel, but it is contemplated that they could be angled with respect to each other. The surfaces 84, 86 define the thickness of the chisel portion 82, which is less than or equal to the depth of the catch trough 60. The chisel portion 82 has side surfaces 85 that define a width. The chisel portion 82 has a ramp surface 88 that terminates at a chisel edge 90. The ramp surface 88 faces outward and is located in the transverse notch 52 and partially obscures the bottom of the notch 54 in the unlocked position. The chisel portion 82 includes a protruding grip surface 92. The protruding grip surface 92 provides a place for the user to place their finger or thumb to move the catch 80 between the locked and unlocked position. The catch 80 has a narrowed portion 94 with catch stop surfaces 96 between the chisel portion 82 and narrowed portion 94. The narrowed portion 94 has side surfaces 87 and fits within the narrow area 70 and the chisel portion 82 fits within the catch trough 60. The catch 80 is long to provide support and stability when it is in the locked position. Without sufficient length, outward force exerted on the inward facing surface 86 could cause the catch 80 to move outwardly and allow the catch 80 to escape the catch trough 60.

A spring 100 resides in the narrow area 70 and is located between the spring support surface 72 and the narrowed portion 94. A spring support post 98 on the catch 80 along with the width of the narrow area 70 keeps the spring 100 in position. The spring 100 provides a biasing force to push the catch 80 towards the locked position, as shown in FIG. 3. In the locked position, the chisel edge 90 is in biased contact with the far notch surface 58 and part of the chisel portion 82 interrupts and blocks the transverse notch 52. The ramp surface 88 faces outwardly. As assembled into the latch 32, the narrow area 70 and spring 100 are completely covered by the tube 100.

As assembled to the main body 40, the catch 80 slides between the locked position where the chisel edge 90 contacts the far notch surface 58. In the unlocked position, the catch stop surfaces 96 contact the backstop surfaces 68 and the chisel portion 82 is clear of the transverse notch 52, as shown in FIGS. 5 and 6. Without the tube 20 surrounding the tube portion 42, the catch 80 is insufficiently constrained and can easily fall out of the catch trough 60. The outside surfaces 110, 112, 114, 116 of the tube portion 42 are surrounded by the inside surfaces 120, 122, 124, 126 of the tube 20. Assembly of the main body 40, catch 80, and spring 100 into the tube 20 completes the assembly of the latch 32. As assembled, the outward facing surface 84 will contact the inside surface 120 of the tube 20 to prevent the catch 80 and spring 100 from becoming separated from the main body 40. This is shown in FIGS. 3 and 5. The hook portion 44 has outside surfaces 74, 76 that define a width that closely matches the adjacent outside surfaces of the tube 20. This is shown on FIG. 6. The hook portion 44 further includes outside surfaces 75, 77 that closely matches corresponding outside surfaces of the tube 20.

The mounting bracket 34 is affixed to the watercraft 12 and has upstanding walls 140, 142. As shown, the upstanding walls 140, 142 are parallel, but it is contemplated that they are angled with respect to each other. The upstanding walls 140, 142 have corresponding pin apertures 144, 146 that align on a pin axis 148. A pin 150 extends through the apertures 144, 146 and is secured to the walls 140, 142. Aperture 144 is shown as threaded and aperture 146 is shown as having a countersink feature, but this is not required. It is contemplated that one or both apertures are straight holes. It is further contemplated that the pin 150 is a rivet, shaft, or integral to the mounting bracket 34. The pin 150 is also referred to as a hinge pin 150 because it provides a pivot axis for the latch 32. The walls 140, 142 are spaced apart to define a width. The width is wider than the width of the tube 20 and the hook portion 44. The pin 150 may include a locknut 152 to prevent the pin 150 from loosening due to vibration, temperature changes, or repeated latching and unlatching. The transverse notch 52 between the bottom of the notch 54 and the inward facing surface 86 of the catch 80 forms an elongate hinge pocket 130, shown in FIG. 3. The pin 150 is sized to fit in the hinge pocket 130 between the notch surfaces 56, 58. The mounting bracket 34 as shown encircles the railing with a box portion 154, but it is contemplated that it is a flange mount, C-shaped, or H-shaped, depending on the style of watercraft 12 or railing where it is affixed. When the latch 32 is connected to the mounting bracket 34, the central axis 36 intersects the pin axis 148. This allows the latch and mounting bracket 34 to act as a hinge where the latch 32 pivots about the pin axis 148.

To connect the latch 32 to the mounting bracket 34, the user simply aligns the pin 150 with the opening of the transverse notch 52. The user moves the latch toward the pin 150, where it contacts the ramp surface 88. The user then may manually retract the catch 80 with the grip surface 92 or allow the pin 150 to push the catch 80 towards the unlocked position with the ramp surface 88 transferring the force to move the catch 80 parallel to the central axis 36. By applying pressure to the ramp surface 88 by the pin 150, the latch 32 can be latched or connected to the mounting bracket by only applying force to displace the catch 80. The motion to connect the latch 32 to the mounting bracket 34 is perpendicular to the central axis 36. As soon as the pin 150 passes the chisel edge 90, the spring moves the catch 80 to the locked position. To disconnect the latch 32 from the mounting bracket 34, the user presses on the grip surface 92 to move the catch 80 to the unlocked position, where the user can move the latch 32 away from the pin 150 as shown in FIG. 5.

The latch 32 and mounting bracket 34 provide a hinge by allowing the latch 32 to pivot about the pin 150 and pin axis 148 in the latched position. The width of the latch 32 between the upstanding walls 140, 142 prevents excessive movement of the latch along the pin axis 148.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A Bimini frame and release system comprising:

an elongate hollow frame tube having a terminal end;

a main body having a hook portion and a tube portion, said hook portion having a transverse notch extending therethrough and having a depth, said main body having a central axis, said main body having a catch trough having a bottom surface extending from said tube portion and terminating at said transverse notch, said tube portion located in said terminal end of said hollow frame tube and having a retaining aperture extending therethrough;

a catch received by said catch trough, said catch slidable within said catch trough in a direction parallel to said central axis between a locked position and an unlocked position, said locked position defined by said catch interrupting said catch trough, said unlocked position defined by said catch clear of said catch trough, said catch having a chisel portion with a ramp surface terminating at a chisel edge located on a terminal end, said chisel portion having an outward facing surface parallel to an inward facing surface, said catch having a grip surface protruding beyond said outward facing surface;

a spring held between said catch and said catch trough, said spring biases said catch towards said locked position;

when said tube portion of said main body is received by and affixed to said frame tube, said catch is constrained in said catch trough by an inside surface of said hollow frame tube;

a bracket for receiving and releasably connecting to said main body, said bracket having upstanding walls, said upstanding walls each having a pin aperture, said pin apertures aligning to form a pin axis, said pin apertures receiving a pin extending between and affixed to said pin apertures.

2. The frame and release system in claim 1, said main body only pivotable about said pin axis when said pin is captured between said inward facing surface and said transverse notch.

3. The frame and release system in claim 1, said catch having a catch stop surface, said catch trough having a backstop surface, said catch stop surface contacting said catch trough surface in said unlocked position.

4. The frame and release system in claim 1, said pin orthogonally intersecting said central axis when said bracket is connected to said main body.

5. The frame and release system in claim 1, said catch trough having a planar bottom surface, said catch having a planar inward facing surface overlaying said planar bottom surface.

6. The frame and release system in claim 1, wherein said grip surface is adjacent said ramp surface.

7. The frame and release system in claim 1, said main body latchable to said bracket by sliding said pin into said transverse notch in a direction perpendicular to said central axis.

8. The frame and release system in claim 1, said chisel edge aligned with a close notch surface when said catch is in said unlocked position.

9. A releasable Bimini top frame hinge for removably affixing to a watercraft, said frame hinge comprising:

an elongate hollow tube having a central axis, inside surfaces, and a terminal end;

a main body affixed to said terminal end and aligned with said central axis, said main body having a transverse notch extending through said main body and orthogonally intersecting said central axis, said main body having a catch captured between one of said inside surfaces of said tube and said main body, said catch linearly slidable between a locked position and an unlocked position, said locked position defined by a ramp surface of said catch obstructing a portion of said transverse notch and a chisel edge of said catch contacting a far notch surface of said transverse notch, said unlocked position defined by said chisel edge being spaced from said transverse notch;

a spring biasing said catch towards said locked position;

a mounting bracket having upstanding walls and a pin affixed therebetween, said pin located on a pin axis; and said mounting bracket connectable to said main body when said pin is moved into said transverse notch, said pin displacing said catch when said pin contacts said ramp surface, said mounting bracket connected to and pivotable with respect to said mounting bracket about said pin axis when said pin is located between an inward facing surface of said catch and a bottom surface of said transverse notch.

10. The releasable frame in claim 9, said spring located inside said tube.

11. The releasable frame in claim 10, wherein said catch has a spring guide post, a portion of said spring encircling said spring guide post, said spring contacting a spring support surface in said main body.

12. The releasable frame in claim 9, said catch having a catch stop surface, said main body having a backstop surface, said catch stop surface contacting said backstop surface when said catch is in said unlocked position.

13. The releasable frame in claim 9, said main body having a shoulder surface abutting said terminal end of said hollow tube.

14. The releasable frame in claim 9, said main body having a hook portion and a tube portion, said tube portion located inside said tube, said hook portion having said transverse notch, said catch extending between said hook portion and said tube portion.

15. The releasable frame in claim 9, said main body having a retaining aperture extending therethrough and parallel to said transverse notch, said main body held to said tube by a fastener extending through said tube and said retaining aperture.

16. A releasable Bimini top for a watercraft, said top comprising:

a frame formed of a plurality of elongate hollow tubes, said hollow tubes having a terminal end;

said watercraft having a plurality of mounting brackets having upstanding walls with a hinge pin extending therebetween, said hinge pin having a pin axis;

said terminal end having a latching hinge with a main body with a central axis, a catch slidable between a locked and an unlocked position parallel to said central axis, and a spring biasing said catch toward said locked position, said catch captured between said main body and said hollow tube, said main body having a transverse notch with a bottom surface, when said catch is in said locked position, an inward facing surface on said catch and said bottom surface of said notch forming a hinge pocket to receive said hinge pin, said catch having a ramp surface meeting said inward facing surface at a chisel edge, said chisel edge contacting a far notch surface when said catch is in said locked position; and said latching hinge pivotable only about said pin axis when said latching hinge is latched to said mounting bracket and said catch is in said locked position.

17. The releasable Bimini top in claim 16, said transverse notch having a close notch surface parallel to said far notch surface, said chisel edge located between said close notch surface and said far notch surface in said locked position, said chisel edge clear of said close notch surface in said unlocked position.

18. The releasable Bimini top in claim 16, said central axis intersecting said pin axis when said latching hinge is latched to said mounting bracket.

19. The releasable Bimini top in claim 16, said transverse notch is perpendicular to said central axis.

* * * * *